US008881817B2

(12) United States Patent
Perschke et al.

(10) Patent No.: US 8,881,817 B2
(45) Date of Patent: Nov. 11, 2014

(54) CUTTING TOOL

(75) Inventors: Malcolm Perschke, Spring, TX (US); Harshad Patil, Houston, TX (US); Nishant Koti, Houston, TX (US)

(73) Assignee: Smith International, Inc., Houston, TX (US)

( * ) Notice: Subject to any disclaimer, the term of this patent is extended or adjusted under 35 U.S.C. 154(b) by 731 days.

(21) Appl. No.: 12/859,017

(22) Filed: Aug. 18, 2010
(Under 37 CFR 1.47)

(65) Prior Publication Data

US 2011/0290487 A1 Dec. 1, 2011

Related U.S. Application Data

(60) Provisional application No. 61/234,868, filed on Aug. 18, 2009.

(51) Int. Cl.
*E21B 29/00* (2006.01)

(52) U.S. Cl.
CPC ..... *E21B 29/007* (2013.01)
USPC ..... 166/298; 166/297; 166/55; 30/92; 30/93; 30/94; 30/95

(58) Field of Classification Search
CPC ..... E21B 29/00; E21B 29/002
USPC ..... 166/55.6
See application file for complete search history.

(56) References Cited

U.S. PATENT DOCUMENTS

| | | | | | |
|---|---|---|---|---|---|
| 2,277,580 | A * | 3/1942 | Carothers | ..... | 166/55.6 |
| 2,304,793 | A * | 12/1942 | Bodine, Jr. | ..... | 166/298 |
| 2,418,278 | A * | 4/1947 | Reed | ..... | 166/55.6 |
| 3,080,241 | A * | 3/1963 | Campbell | ..... | 166/55.6 |
| 3,174,548 | A * | 3/1965 | Webb | ..... | 166/55.6 |
| 3,396,794 | A * | 8/1968 | Webb | ..... | 166/55.6 |
| 3,848,667 | A * | 11/1974 | Clark, Jr. | ..... | 166/55.6 |
| 4,047,568 | A * | 9/1977 | Aulenbacher | ..... | 166/298 |
| 4,662,436 | A * | 5/1987 | Parra et al. | ..... | 166/55.6 |
| 5,036,921 | A * | 8/1991 | Pittard et al. | ..... | 166/298 |
| 5,253,710 | A * | 10/1993 | Carter et al. | ..... | 166/298 |
| 7,063,155 | B2 * | 6/2006 | Ruttley | ..... | 166/298 |

* cited by examiner

*Primary Examiner* — Jennifer H Gay
*Assistant Examiner* — Caroline Butcher
(74) *Attorney, Agent, or Firm* — Osha Liang LLP

(57) ABSTRACT

A downhole tool having a cylindrical body, a sleeve having a contact portion disposed on a distal end, and a cutter having a radiused portion on a top surface operatively engageable with the contact portion. Also, a method of cutting drill pipe, the method including disposing a cutting tool in a wellbore around the drill pip and actuating a radiused cutter of the cutting tool, wherein the actuating includes radially extending the cutter into contact with the drill pipe. The method also includes applying a substantially constant force between the cutter and the drill pipe and rotating the cutting tool. Additionally, a cutter for a drill pipe cutting tool, the cutter including a work surface located at a first end of the cutter, an attachment point located at a second end of the cutter, and a radiused surface located between the work surface and the attachment point.

20 Claims, 5 Drawing Sheets

CUTTING TOOL

CROSS-REFERENCE TO RELATED APPLICATION

The present application claims priority to U.S. Provisional Patent Application Ser. No. 61/234,868, filed Aug. 18, 2009, and is hereby incorporated by reference in its entirety.

BACKGROUND

1. Field of the Disclosure

Embodiments disclosed herein relate generally to apparatuses and methods for cutting drill pipe from a wellbore. More specifically, embodiments disclosed herein relate to apparatuses and methods for cutting drill pipe using a washover cutting tool. More specifically still, embodiments disclosed herein relate to methods of cutting drill pipe using a cutting tool with a cutter having a radiused surface.

2. Background Art

During workover and well maintenance operations drill pipe and/or tubing may become stuck in a wellbore. Typically, when a drill pipe or tube becomes stuck in a wellbore, a washover tool may be used to washover the stuck drill pipe or tube in an attempt to free the stuck pipe or tube. However, in many instances, the stuck pipe or tube is not freed by the washover operation. In such a circumstance, it may become necessary to cut the stuck pipe or tube, thereby allowing the upper portion of the stuck pipe or tube to be removed from the wellbore. Examples of drill pipe may include, integral jointed tubing and collared tubing.

To cut the stuck drill pipe, an external cutting tool may be lowered over the pipe during the washover operation. Cutters are then actuated to engage the outer diameter of the stuck drill pipe, and as the cutting tool is rotated, the cutters cut the pipe from an outer diameter to an inner diameter. After the drill pipe is entirely cut, a grapple may be used to remove the cut upper portion of the drill pipe from the wellbore.

Engagement of the cutters of the cutting tool with the outer diameter of the drill pipe typically occurs through actuation of a sleeve by a spring of the cutting tool contacting a flat top surface of the cutter. The vertical force applied by the spring through the sleeve of the cutting tool to the flat top surface of the cutter thereby forces the cutter into engagement with the outer diameter of the still pipe. Conventional external diameter cutting tools having flat top cutters have been successful in cutting drill pipe having relatively thin walls. However, drill pipe having relatively thick walls would not make a complete cut because of a reducing spring force as the knife cuts through the pipe. The flat top surface of the cutters resulted in a decreasing horizontal component of the normal force acting on the cutters as the sleeve of the cutting tool continued to contact the flat top surface of the cutter during operation. Thus, if a wall of the drill pipe is too thick or the outside diameter of the drill pipe is too great, then external cutters may not be capable of cutting through the entire drill pipe.

Accordingly, there exists a need for advanced external pipe cutting tools and cutters capable of cutting large diameter and/or thick walled drill pipe.

SUMMARY OF THE DISCLOSURE

In one aspect, embodiments disclosed herein include a downhole tool having a cylindrical body, a sleeve having a contact portion disposed on a distal end, and a cutter having a radiused portion on a top surface operatively engageable with the contact portion.

In another aspect, embodiments disclosed herein include a method of cutting drill pipe, the method including disposing a cutting tool in a wellbore around the drill pip and actuating a radiused cutter of the cutting tool, wherein the actuating includes radially extending the cutter into contact with the drill pipe. The method also includes applying a substantially constant force between the cutter and the drill pipe and rotating the cutting tool.

In another aspect, embodiments disclosed herein include a cutter for a drill pipe cutting tool, the cutter including a work surface located at a first end of the cutter, an attachment point located at a second end of the cutter, and a radiused surface located between the work surface and the attachment point.

Other aspects and advantages of the invention will be apparent from the following description and the appended claims.

DETAILED DESCRIPTION

In one aspect, embodiments disclosed herein relate to apparatuses and methods for cutting drill pipe from a wellbore. More specifically, embodiments disclosed herein relate to apparatuses and methods for cutting drill pipe using a washover cutting tool. More specifically still, embodiments disclosed herein relate to apparatuses and methods for cutting drill pipe using a cutting tool with a cutter having a radiused surface.

Mechanical pipe cutting tools according to embodiments disclosed herein have one or more cutters that are configured to be pushed inwardly by a sleeve activated by springs. Thus, during operation, the cutting tool is washed over stuck drill pipe, and when the cutting tool is actuated, the cutters are pushed inwardly by the sleeve into engagement with the drill pipe as a grapple catches an upside portion of drill pipe to be cut. The cutting tool is then rotated and the cutters cut the drill pipe from an outer diameter inward. After the drill pipe is completely cut, the cut portion of the drill pipe may be removed from the wellbore by pulling the cutting tool, including the grappled cut portion of the drill pipe out of the wellbore. Those of ordinary skill in the art will appreciate that additional steps may be required, according to operational constraints or requirements of a particular cutting operation.

Figure 1A:
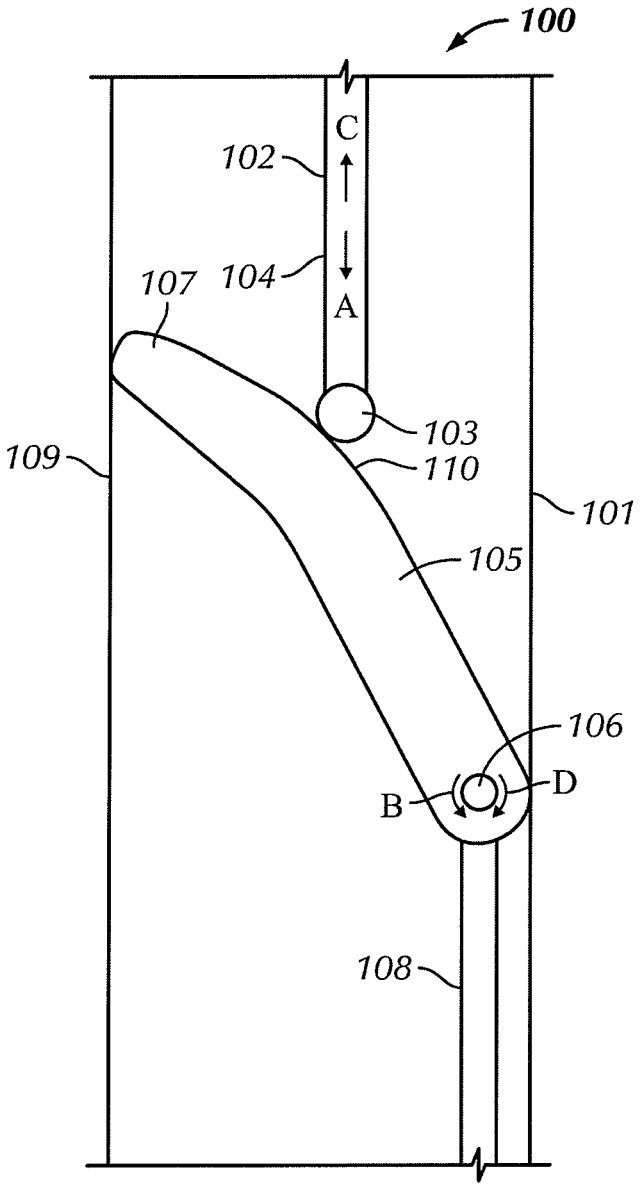
FIG. 1A is a close perspective view of a cutting tool according to embodiments of the present disclosure.

Referring to FIG. 1A, a close perspective view of a cutting tool 100 engaging a drill pipe 109, according to embodiments of the present disclosure, is shown. In this embodiment, cutting tool 100 includes a cylindrical body 101 forming the exterior of the cutting tool. Cutting tool 100 also includes a sleeve 102 disposed radially inward from the cylindrical body 101. In other aspects, sleeve 102 may be an integral portion of cylindrical body 101, such that sleeve 102 forms a portion of the exterior of cutting tool 100. Those of ordinary skill in the art will appreciate that the relationship of sleeve 102 to cylindrical body 101 is not a limitation on the scope of the present disclosure.

Figure 2:
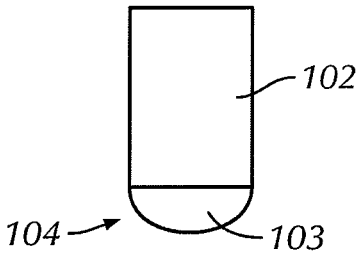
FIG. 2 is a close perspective view of a sleeve according to embodiments of the present disclosure.
Figure 3:
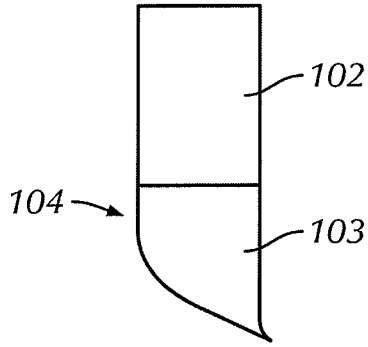
FIG. 3 is a close perspective view of a sleeve according to embodiments of the present disclosure.

Sleeve 102 includes a contact portion 103, which as illustrated includes a first radiused portion disposed at a distal end 104 of sleeve 102. Contact portion 103, as illustrated, has a substantially spherical geometry. However, in other aspects, contact portion 103 may include geometries other than spherical. Referring briefly to FIGS. 2 and 3, alternative contact portion geometries, according to embodiments of the present disclosure, are shown. In FIG. 2, a sleeve 102 having a distal end contact portion 103 is illustrated. In this embodiment, contact portion 103 is an integral portion of sleeve 102, such that the distal end 104 of sleeve 102 terminates in a portion having a semi-circular geometry. In FIG. 3, a sleeve 102 having a distal end contact portion 103 is illustrated as an integral portion of sleeve 102. In this aspect, the distal end 104 of sleeve 102 terminates in a portion having a one-sided radiused profile. Those of ordinary skill in the art will appreciate that depending on the operational requirements of a particular cutting operation, the geometry of contact portion 103 may vary. Examples of parameters that may result in differing contact portion 103 geometries include the amount of force required to actuate cutting tool 100, the geometry of a cutter of the cutting tool 100, the thickness of the drill pipe being cut, and the outer diameter of the pipe being cut.

Referring back to FIG. 1A, contact portion 103 is illustrated in contact with a cutter 105. Cutter 105 includes an attachment point 106 and a work surface 107. Attachment point 106 may include one or more mechanical attachments for securing the cutter to a retainer 108 of cutting tool 100. In this aspect, attachment point 106 includes a single pivot point thereby allowing the cutter to rotate thereabout. Thus, as sleeve 102 is moved axially downward, in direction A, cutter 105 rotates about attachment point 106 in direction B. Similarly, as sleeve 102 is moved in direction C, cutter 105 may rotate about attachment point 106 in direction D.

Cutter 105 may be formed from various materials, such as, steel, and may include ultrahard coatings, such as tungsten carbide, and/or hardfacing applied to portions thereof. In one aspect, a tungsten carbide coating may be applied to a portion of cutter 105, such as work surface 107. Because work surface 107 is configured to contact a drill pipe 109 during operation, coating work surface 107 with tungsten carbide may reduce the wear experienced by cutters 105 during operation, while not interfering with the actuation of cutter 105 via contact with radiused portion 103.

Figure 1B:
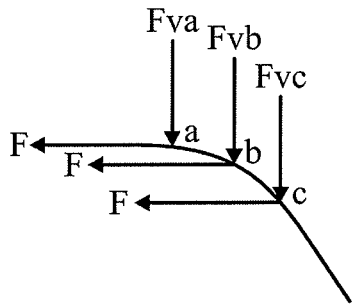
FIG. 1B is a graphical illustration of spring force and knife force according to embodiments of the present disclosure.
Figure 1C:
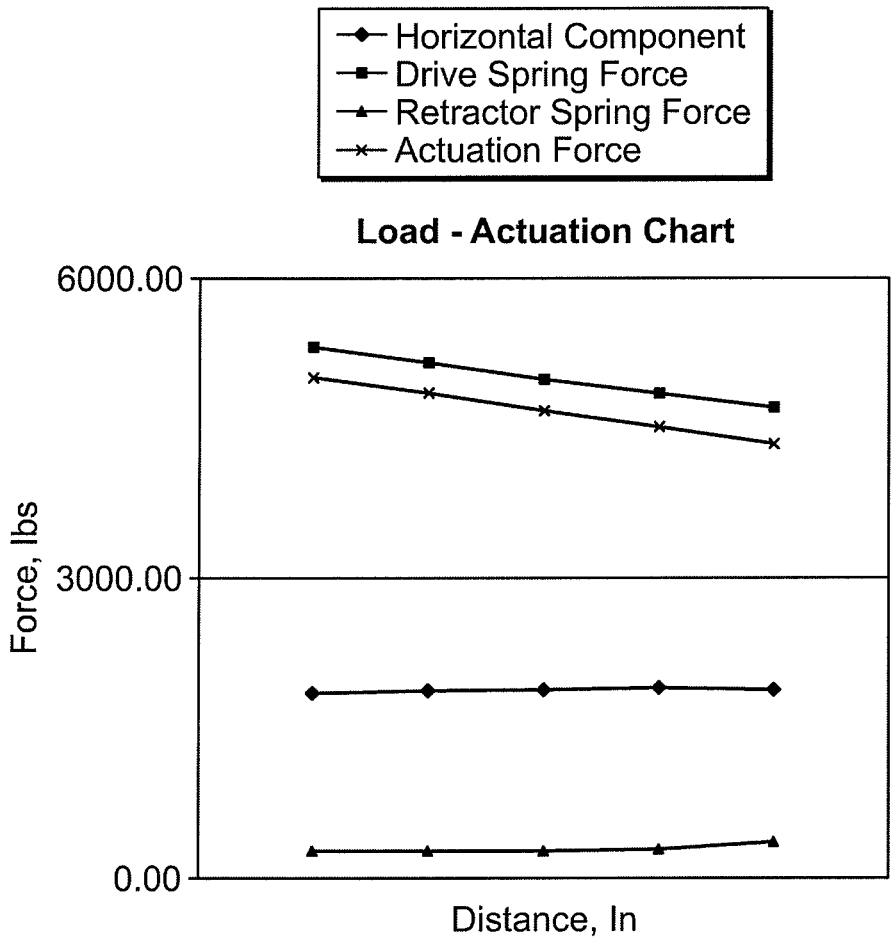
FIG. 1C is a load actuation chart according to embodiments of the present disclosure.

Cutter 105 also includes a radiused top portion 110, which is operatively engageable with the contact portion 103. Radiused top portion 110 of cutter 105 may thereby provide a cam surface, such that the axial movement of sleeve 102 and the resultant contact of contact portion 103 with radiused top portion 110 results in substantially constant force being applied between cutter 105 and drill pipe 109. Accordingly, the radiused top portion 110 of cutter 105 forms a rotating cam, such that force applied to drill pipe 109, as the pipe is cut, will remain constant. Furthermore, the force applied by contact portion 103, as a result of the axial movement of sleeve 102 in direction A, may also remain substantially constant. Referring briefly to FIG. 1B, the force of the spring Fva, Fvb, and Fvc on the cutter at positions a, b, and c, respectively, may remain substantially constant, thereby resulting in a substantially constant horizontal force component F. In certain embodiments the force will be considered substantially constant when the force varies less than about 10 percent. In still other embodiments, the force will be considered substantially constant when the force varies about 5 percent. Referring briefly to FIG. 1C, a load actuation chart showing relative horizontal component forces, drive spring forces, retractor spring forces, and actuation forces, according to embodiments of the present disclosure are shown. As illustrated, the horizontal component of the force remains substantially constant throughout the cut, while the drive spring force and actuation force may decrease.

Referring back to FIG. 1A, because the force between contact portion 103 and radiused top portion 110 of cutter 105 remains substantially constant, the amount of force applied to drill pipe 109 by work surface 107 may also remain substantially constant. In one aspect, the horizontal force required to cut drill pipe 109 may range between 200 and 300 pounds. Thus, the vertical force applied to cutter 105 by sleeve 102 must be sufficient to generate such a horizontal force. Those of ordinary skill in the art will appreciate that generally, 200 pounds of horizontal force is sufficient to cut drill pipe 109. However, depending on the type of pipe being cut, as well as the type of cutter being used, the horizontal force required to cut drill pipe 109 may vary. Those of ordinary skill will further appreciate that by applying a substantially constant horizontal force to drill pipe 109 by cutter 105, large diameter or thick wall drill pipe may be cut completely through.

Figure 4:
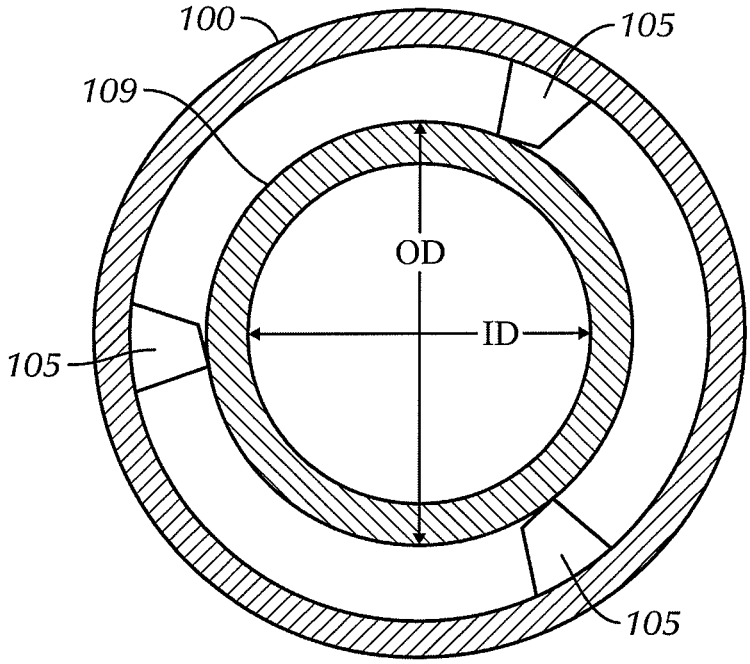
FIG. 4 is a cross-section of a cutting tool engaging drill pipe according to embodiments of the present disclosure.

Cutters 105 disposed on cutting tools 100 according to embodiments disclosed herein may include various configurations. For example, referring briefly to FIG. 4, a cross-section of a cutting tool engaging drill pipe, according to embodiments of the present disclosure, is shown. As illustrated, a cutting tool 100 having multiple cutters 105 is shown engaging a section of drill pipe 109. Cutting tool 100 includes three cutters 105, in this embodiment, which are disposed in approximately 120° increments around cutting tool 100. However, in other aspects, cutting tool 100 may include more or less cutters 105 disposed at various increments. For example, in alternative cutting tools 100, two cutters 105 may be dispose at approximately 180° increments, four cutters 105 may be disposed at approximately 90° increments, or greater or fewer cutters 105 may be disposed at approximately even or varied increments. Accordingly, the number and/or arrangement of cutters 105 around cutting tool 100 is not a limitation of the present disclosure. FIG. 4 also illustrates cutters 105 engaging an outer diameter OD of drill pipe 109, and cutting from the outer diameter OD to an inner diameter ID of the drill pipe 109.

Figure 5:
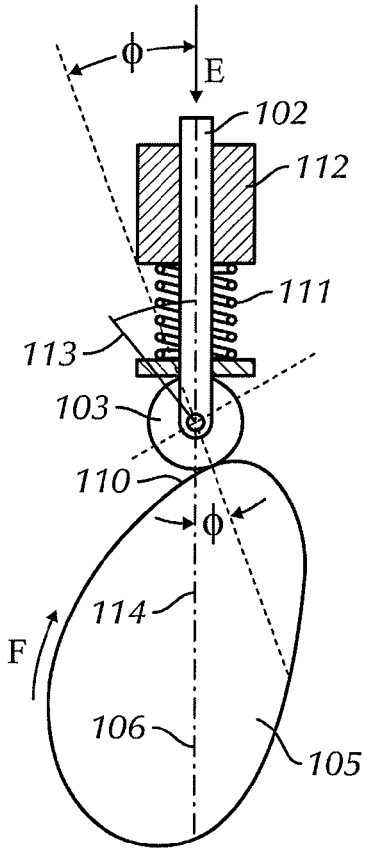
FIG. 5 is a cross-section of a cutter and sleeve.

Referring to FIG. 5, a close perspective view of a cutter and sleeve according to embodiments of the present disclosure is shown. In this embodiment, cutter 105 having a radiused top portion 110 is illustrated in operational engagement with a contact portion 103 of sleeve 102. Sleeve 102 includes a spring 111, such as a preloaded compression spring, which is configured to transmit a specified vertical force along direction E as force is applied at contact portion 112. In this embodiment, contact portion 103 is a spherical surface, however, as explained above, in other aspects, contact portion 103 may include alternate geometries, such as egg-shaped, cardioid, oval, flat and/or elliptical.

As illustrated, cutter 105 is configured to move in a plane perpendicular to the axis of rotation of attachment point 106. Additionally, the centerline 113 of the sleeve 102, and thus the contact portion 103, is inline with the centerline 114 of pivot 106 of cutter 105. In other embodiments, the centerline 113 of sleeve 102 may be offset with the centerline 114 of cutter 105. In such an embodiment, the contact portion 103 may be horizontally offset from the attachment point 106 of cutter 105, or may otherwise be offset from the centerline 114 of cutter 105. Such variants may thereby allow for optimized horizontal force components to be applied to drill pipe for a particular vertical force applied to cutter 105.

In order to optimize the horizontal force component, the common tangent angle between contact portion 103 and cutter 105 may be kept substantially constant throughout the radial extension of cutter 105. Additionally, by decreasing pressure angle $\phi$ (i.e., the angle between the normal force vector and the velocity vector at the contact point), the slip velocity (i.e., the tangential velocity of the contact points of the cutter 105 and contact portion 103) may be decreased and the forces transmitted from the linear motion of the sleeve 102 moving in direction E to the angular motion of the cutter 105 moving in direction F may be increased.

Figure 6:
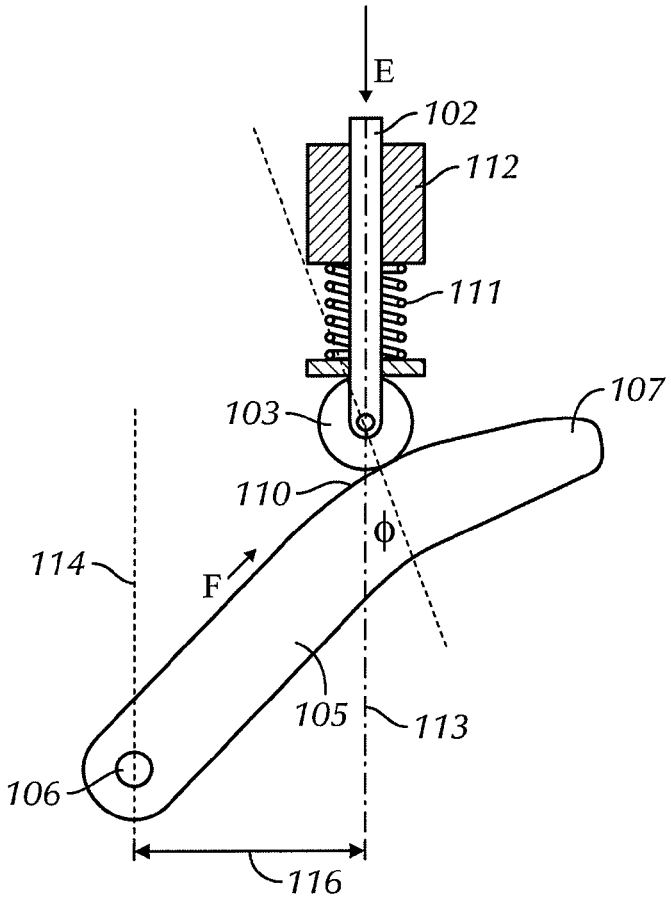
FIG. 6 is a close perspective view of a cutter and sleeve according to embodiments of the present disclosure.

Referring to FIG. 6, a close perspective view of a cutter and a sleeve according to embodiments of the present disclosure is shown. In this embodiment, cutter 105 having a radiused top portion 110 is illustrated in operational engagement with a radiused distal end of a sleeve 102. Sleeve 102 also includes a spring 111, which may be configured to apply a specified vertical force along direction E as force is applied at contact portion 112. In this embodiment, centerline 113 of sleeve 102 is offset with centerline 114 of pivot point 106 of cutter 105. The horizontal offset 116 defines a distance between attachment point 106 of cutter 105 and the centerline 113 of sleeve 102 and contact portion 103. By varying horizontal offset 116, a horizontal force component applied to drill pipe by cutter 105 may be optimized. Thus, in one aspect, the horizontal offset 116 may be increased (e.g., in the direction of the work surface 107), thereby increasing the horizontal component of the force applied to drill pipe by cutter 105 for a particular force applied in direction E by sleeve 102.

Furthermore, by keeping a common tangent angle between contact portion 103 and cutter 105 substantially constant throughout the radial extension of cutter 105, the force applied to the drill pipe by cutter 105 may also be held substantially constant. As explained above, to further optimize a force applied to drill pipe, the slip velocity may be decreased by decreasing pressure angle $\phi$. Those of ordinary skill in the art will appreciate that pressure angle $\phi$ may be decreased by modifying the location of attachment point 106, increasing or decreasing horizontal offset 116, and/or modifying the contact portions 103 and 110 of sleeve 102 and/or cutter 105.

Figure 7:
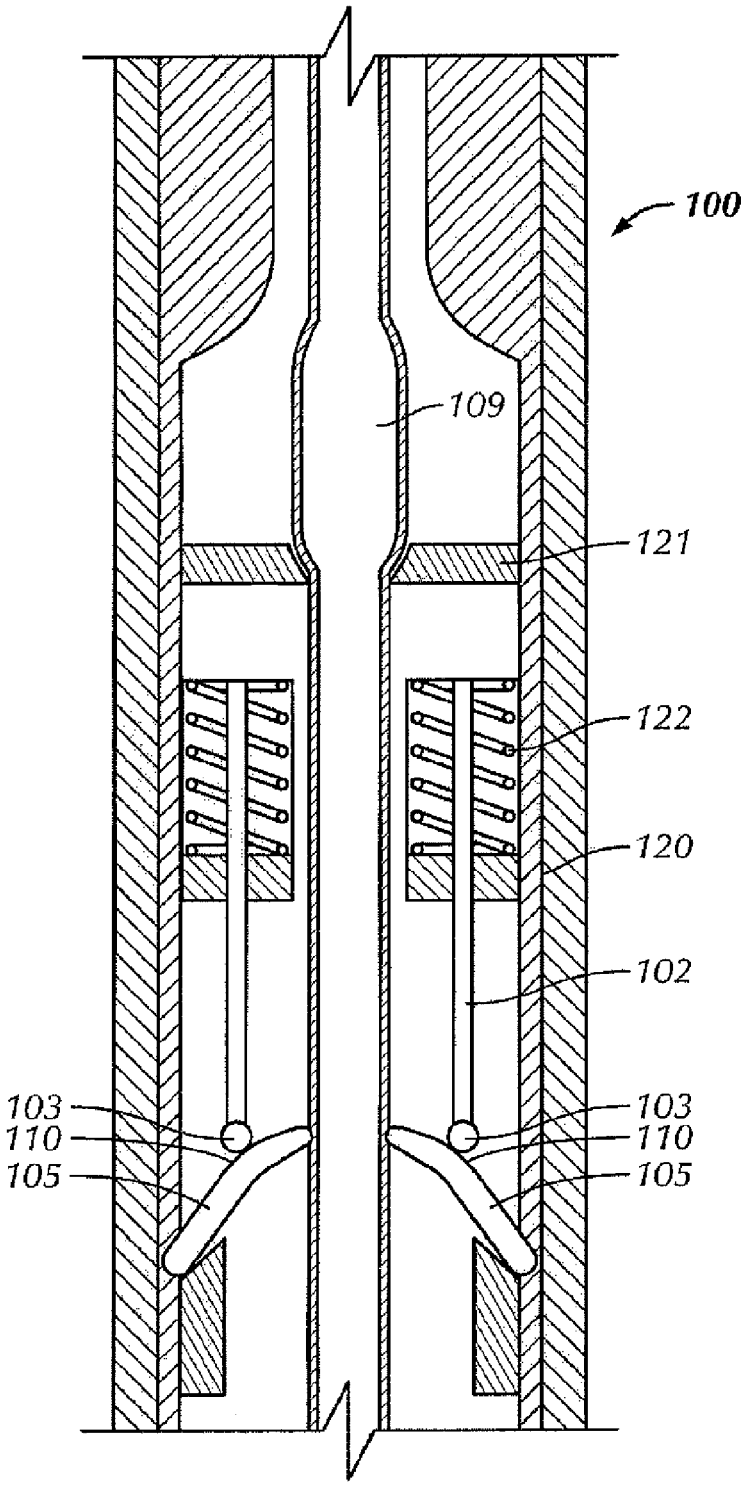
FIG. 7 is a partial cross-section view of a cutting tool according to embodiments of the present disclosure.

Referring to FIG. 7, a partial cross-sectional view of a cutting tool according to embodiments of the present disclosure is shown. In this embodiment, a cutting tool 100 having a cylindrical body is illustrated disposed in a wellbore 120. In this embodiment, cutting tool 100 is disposed around a portion of drill pipe 109. Cutting tool 100 includes several cutters 105 having radiused top portions 110 in engagement with contact portions 103 of sleeve actuators 102. Cutting tool 100 also includes one or more springs 122 disposed above sleeve actuators 102. In certain embodiments, cutting tool 100 may include one spring configured to engage one actuator sleeve 102. However, in alternate embodiments, cutting tool 100 may include multiple springs 122 configured to engage one or more sleeve actuators 102. As such, cutters 105 may be actuated together or independently, depending on the number of springs 122 and sleeve actuators 105.

As illustrated, as contact portion 103 of sleeve actuators 102 are forced into contact with cutters 105, cutters 105 radially extend inward into contact with drill pipe 109. Thus, cutters 105 are radially extended inwardly into contact with an external surface of drill pipe 109, such that as the cutting tool 100 is rotated, the cutters 105 engage and cut drill pipe 109.

Cutting tool 100 also includes a spearing device 121, or grapple, that is configured to engage drill pipe 109 during cutting operations. Spearing device 121 may be internal to the cylindrical body of cutting tool 100, or in other embodiments, may be a separate component of a cutting tool assembly. In such an embodiment where spearing device 121 is a separate component of a cutting tool assembly, the spearing device 121 may be internally or externally spearing. In such an aspect, spearing device 121 may be disposed axially upward of cutting tool 100, and may engage drill pipe 109 before, during, and after the cutting operation. Thus, drill pipe 109 may be held in place during drilling, and as the cutting tool assembly is removed from the wellbore 120, the cut section of the drill pipe 109 may also be removed from the wellbore.

In certain embodiments, cutting tool 100 may include connections (not shown), such as pin and box connection, configured to allow cutting tool 100 to couple with other cutting tool assembly components. Examples of other cutting tool components that may be integral to or configured to couple with cutting tool 100 include washover shoes. Washover shoes may be used to remove cement and/or debris from around drill pipe 109, thereby allowing cutters 105 to engage and cut drill pipe 109. Those of ordinary skill in the art will appreciate that other components of a cutting tool assembly in accordance with the embodiments disclosed herein may also be coupled to either an axially proximate or distal end of cutting tool 100.

During operation, various methods of using the cutters and cutting tool assemblies disclosed herein may be practiced to cut and remove drill pipe from a well. In one embodiment, a cutting tool is disposed in a wellbore around the drill pipe. The drill pipe may include stuck drill pipe, or a portion of drill pipe that is damaged, such that remove of the damaged pipe section is required before drilling and/or production may resume. After disposing the cutting tool in the wellbore, a radiused cutter of the cutting tool is actuated by radially extending the cutter into contact with the drill pipe. In one aspect, the radial extension occurs by contacting a radiused portion of a sleeve of the cutting tool with a radiused top surface of the cutter.

By maintaining a substantially constant vertical force between the sleeve and the cutters, a substantially constant force may thereby be applied between the cutter and the drill pipe. Furthermore, because the force on the drill pipe is directly proportional to the force between the sleeve and the cutter, the force between the cutter and the drill pipe may be held constant throughout the cutting operation. The actuation of the cutters into engagement with the drill pipe may also include applying a substantially constant horizontal force on the drill pipe as the drill pipe is cut. The substantially constant horizontal force on the drill pipe may be maintained during the cutting operation by, for example, continuously causing a spring of the sleeve to impart a particular force to the cutter. In certain aspects the sleeve and/or spring may impart force to the cutter by pumping fluid into contact with the sleeve at a particular pressure, thereby causing the sleeve to move vertically a specific distance. The greater the distance the sleeve moves, the greater horizontal force may be imparted to between the cutter and the drill pipe. Those of ordinary skill in the art will appreciate that as the drill pipe is cut, the cutter may extend radially inward a greater distance than it initially did. Thus, to continue to impart a substantially constant force between the cutter and the drill pipe, the sleeve may require movement an additional vertical distance. To increase the radial extension of the cutter, a higher flow of fluid may be used to move the sleeve an additional vertical distance. Thus, as the cutting operation progresses, increased fluid flow rates may be required to keep the force on drill pipe by the cutter constant.

Because the cutter, in embodiments of the present disclosure, has a radiused top portion, as additional vertical force is required to radially expand the cutters, the force applied to the drill pipe by the cutters may be maintained. Traditional cutters having a flat top surface may not be capable of maintaining the horizontal force between the cutters and the drill pipe. Thus, traditional cutters may fail to cut the entire thickness of a drill pipe having too great an outer diameter.

After the drill pipe is cut, a flow of fluid may be decreased or stopped all together, thereby removing the vertical force acting on the cutter and allowing the cutter to radially expand back into the body of the cutting tool. In certain embodiments, the cutters may remain radially expanded as the drill pipe is removed from the wellbore, however, in certain applications, the cutters may return to an unexpanded orientation.

In addition to cutting drill pipe, methods disclosed herein may also include engaging a spearing device, such as a grapple, with the drill pipe. The spearing device may be engaged prior to cutting, to help centralize the drill pipe in the cutting tool, as well as to stabilize the pipe during cutting. Centralizing and stabilizing the drill pipe may result in a more efficient cutting operation, and may also result in less wear to cutters of the cutting tool.

Methods may also include performing a washover operation prior to cutting the drill pipe. A washover includes placing a distal end of the cutting assembly including a washover shoe over a portion of the pipe and rotating the cutting tool assembly to help dislodge and remove debris that may be holding the drill pipe in place. As the pipe is exposed, the cutting tool may be lowered into engagement with the pipe, a grapple may be engaged with a top segment of the pipe, and the cutting operation may commence as discussed above. In certain operations, washovers may also include providing a high-pressure flow of fluid into contact with the stuck pipe, further helping to remove debris from around the pipe.

Advantageously, embodiments of the present disclosure may provide methods of cutting pipe from a wellbore. Because traditional methods of cutting pipe from an external diameter of the pipe inward often resulted in incomplete cuts due to a lack of horizontal force, the present methods may more efficiently and effectively cut though large diameter pipe or pipes with large wall thicknesses. Because embodiments of the present disclosure may provide for complete cuts, as opposed to incomplete cuts, time and resources may be saved during workover and/or drilling operations, thereby decreasing the cost of the drilling operation.

Also advantageously, embodiments of the present disclosed may provide cutters and cutting tool assemblies capable of providing a substantially constant force between the cutter and the drill pipe throughout the cutting operations. Typically, cutting tool assemblies including radially inward expandable cutters were limited in the amount of force that could be applied to the drill pipe due to at least in part to the substantially flat top surface of the cutters. Such flat top surface cutters require a higher load spring to enable cutting drill pipe with thick walls. Higher load spring are typically more expensive, thus, cutting tools capable of cutting thick wall drill pipe having flat top surface cutters are typically expensive, which results in an increased cost of the drilling operation. Additionally, cutting tool assemblies having flat top surface cutters and higher load springs may fail during the cutting operation, causing the spring to radially expand, thereby damaging the cutters, as well as the cutting tool assembly.

The radiused cutters and corresponding radiused portions of sleeves of the cutting tools of the present application may thereby provide cutters that are capable of providing a substantially constant force between the cutter and the drill pipe throughout the cutting operation. Moreover, the amount of force may be optimized to achieve a particular cutting speed or to minimize cutter wear, because the force is substantially constant throughout the cutting operation. As such, in certain applications, an engineer may choose to increase the force applied to the drill pipe in an attempt to cut the pipe more quickly, while in other applications, the force may be decreased in order to decreased the amount of wear experienced by a cutter.

Also advantageously, methods disclosed herein may allow for a substantially constant force in the range of 200-300 pounds to be applied by the cutter to the drill pipe during cutting. The constant force may thereby allow pipe having an external diameter of greater than 5.5 inches to be cut using inwardly expandable cutters. For example, heavy wall pipe having external diameters of 5.75 inches and 5.875 inches or larger may be cut.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A downhole tool comprising:

a cylindrical body;

a sleeve having a contact portion disposed on a distal end, the sleeve including a spring disposed above the contact portion; and a cutter having a radiused portion on a top surface, the radiused portion operatively engageable with the contact portion, the contact portion being configured to exert a substantially constant amount of force on the radiused portion.

2. The downhole tool of claim 1, wherein the cutter is configured to extend radially inward into the cylindrical body.

3. The downhole tool of claim 1, wherein the cylindrical body comprises a washover pipe.

4. The downhole tool of claim 1, wherein the cutter further comprises:

a work surface having an ultrahard material disposed thereon.

5. The downhole tool of claim 1, wherein the contact portion comprises at least one of a substantially spherical surface, an oblong surface, a flat surface, an egg-shaped geometry, a cardioid geometry, an oval geometry, a flat geometry, or an elliptical geometry.

6. The downhole tool of claim 1, wherein the contact portion comprises a second radiused portion.

7. The downhole tool of claim 1, wherein a centerline of the sleeve is offset from a centerline of the cutter.

8. The downhole tool of claim 1, wherein the contact portion has a spherical, elliptical, circular, or semi-circular geometry contacting the radiused portion on the top surface of the cutter, the cutter being configured to radially expand in response to downward translation of the contact portion against the radiused portion on the top surface of the cutter, and to radially retract in response to upward translation of the contact portion while contacting the radiused portion on the top surface of the cutter.

9. A method of cutting drill pipe, the method comprising:

disposing a cutting tool in a wellbore around the drill pipe;

actuating a radiused cutter of the cutting tool, wherein the actuating includes:

radially extending the cutter into contact with the drill pipe; and applying a substantially constant amount of force between the cutter and the drill pipe, wherein the applying includes:

applying a vertical force between a sleeve of the cutting tool and a radiused portion of the radiused cutter;

rotating the cutting tool; and increasing the vertical force on the sleeve to maintain the substantially constant amount of force between the cutter and the drill pipe.

10. The method of claim 9, wherein the applying the substantially constant amount of force further comprises:

applying a substantially constant amount of horizontal force on the drill pipe.

11. The method of claim 9, wherein the actuating further comprises contacting a sleeve of the cutting tool with the radiused portion of the radiused cutter.

12. The method of claim 11, wherein the force on the drill pipe is directly proportional to the force between the sleeve and the radiused cutter.

13. The method of claim 9, further comprising:

spearing the drill pipe.

14. A cutting tool comprising:

a first cutter disposed at a first position along a longitudinal axis of the cutting tool;

a second cutter disposed at the first position along the longitudinal axis, thereby longitudinally aligned with the first cutter;

a work surface located at a first end of the first cutter;

an attachment point located at a second end of the first cutter;

a radiused upper surface located between the work surface and the attachment point, the radiused upper surface providing a cam surface configured to provide a substantially constant force applied between at least the first cutter and a work piece; and at least two sleeve actuators configured to actuate the first cutter independently of the second cutter, wherein a first sleeve actuator is configured to actuate the first cutter and a second sleeve actuator is configured to actuate the second cutter.

15. The cutting tool of claim 14, wherein the radiused surface is located on a top surface of the first cutter.

16. The cutting tool of claim 15, wherein the radiused surface is configured to interact with a first of the at least two sleeve actuators.

17. The cutting tool of claim 14, wherein the work surface comprises an ultrahard material.

18. The cutting tool of claim 14, wherein the radiused surface is configured to engage a contact portion of a first of the at least two sleeve actuators.

19. The cutting tool of claim 14, wherein the at least two sleeve actuators further comprise multiple springs, wherein at least one spring is disposed above each sleeve actuator.

20. A method comprising:

disposing a cutting tool in a wellbore around a drill pipe;

actuating a radiused cutter of the cutting tool, the actuating including:

moving a sleeve actuator into contact with a radiused portion of the radiused cutter;

radially extending the radiused cutter inward into contact with the drill pipe; and applying a substantially constant force between the radiused cutter and the drill pipe, an amount of the substantially constant force varying by less than 10 percent; and cutting the drill pipe by rotating the cutting tool.

* * * * *